United States Patent [19]

Meier

[11] Patent Number: 4,657,061

[45] Date of Patent: Apr. 14, 1987

[54] VERTICALLY DISCONTINUOUS BLINDS

[76] Inventor: Francis W. Meier, 43-49 10th St., Long Island City, N.Y. 11101

[21] Appl. No.: 853,920

[22] Filed: Apr. 21, 1986

[51] Int. Cl.[4] ..... E06B 9/26

[52] U.S. Cl. ..... 160/176 R; 160/177; 160/178 R

[58] Field of Search ..... 160/176 R, 166 R, 166 A, 160/174, 177, 178 R, 115, 200, 196 R, 196 D

[56] References Cited

U.S. PATENT DOCUMENTS

| | | | |
|---|---|---|---|
| 504,533 | 9/1893 | Lunhen | 160/196 D |
| 1,095,292 | 5/1914 | Smith | 160/166 A |
| 2,115,663 | 4/1938 | Balthasar | 160/115 |
| 2,117,953 | 5/1938 | Grau | 160/115 |
| 3,500,896 | 3/1970 | Endou | 160/178 R |

*Primary Examiner*—Ramon S. Britts
*Assistant Examiner*—Sarah A. Lechok Eley

[57] ABSTRACT

A vertically discontinuous blind comprised of a plurality of parallel, vertically extending vanes. Each vane of the blind is comprised of a plurality of independent sections mounted on concentrically arranged tubes. Within the headrail from which the vanes are suspended, are means to independently change the angular orientation of each section of a vane. Similar sections of all the vanes maintain a similar angular orientation by pivoting simultaneously through the same angular extent.

8 Claims, 6 Drawing Figures

VERTICALLY DISCONTINUOUS BLINDS

BACKGROUND OF THE INVENTION

Presently, vertical blinds are comprised of a multiplicity of continuous vertical vanes, all controlled with respect to their angular orientations about their respective vertical axes by one control rod so that all vanes pivot simultaneously by the same angular extent.

BRIEF SUMMARY OF THE INVENTION

The object of my invention is to give additional versatilty to vertical blinds, in the areas of light control and aesthetics. Instead of arranging a multiplicity of vertically continuous vanes, a multiplicity of vertically discontinuous vanes are arranged. The discontinuous vane is comprised of a multiplicity of independent sections. Henceforth, the independent sections will be called elements. Each element is mounted on its own independent tube or rod. The words tube and rod are used interchangeably herein.

The tubes are concentric and vary in length and diameter with respect to the element to which it is attached. The innermost tube is the longest, extending from within the headrail to the lowest element. The outermost tube is the shortest, extending from within the headrail to the highest element. The intermediate tubes and elements, if any, are similarly arranged.

Within the headrail from which the vanes are suspended are means to independently control the angular orientation of each tube, thereby determining the angular orientation of their respective elements that comprise a vertically discontinuous vane. The respective elements of a multiplicity of vertically discontinuous vanes maintain a similar angular orientation.

DETAILED DESCRIPTION OF THE INVENTION

Figure 1:
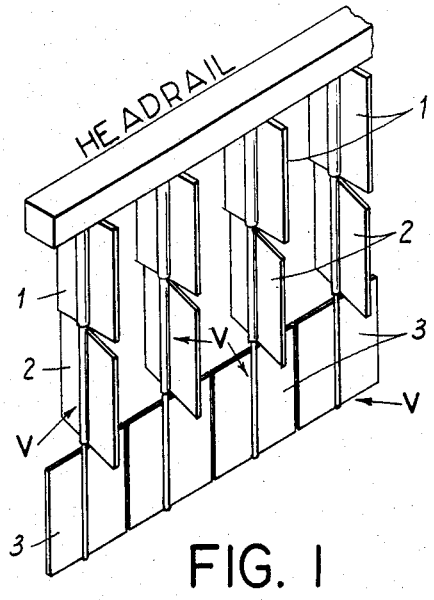
FIG. 1 is an isometric view of the independently controllable, multiple section vertically discontinuous vane blind of my invention.

Referring to FIG. 1, there is illustrated a vertically discontinuous, independently controlled, multiple element vane blind constructed according to the invention. Each vane V is comprised of independently controllable multiple elements 1, 2 and 3.

Element 1 of all the vanes comprise a set. Likewise, elements 2 and 3 comprise their own sets. Each set rotates independently of the other sets. Within a set, elements rotate together and through the same angular degree.

Figure 2:
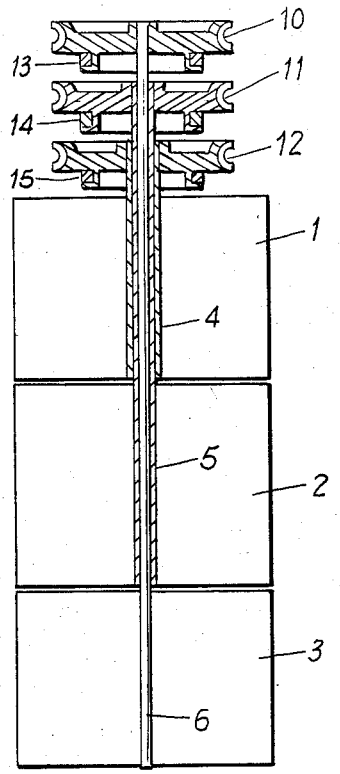
FIG. 2 is a sectional view of a complete vane composed of three independent elements.
Figure 3:
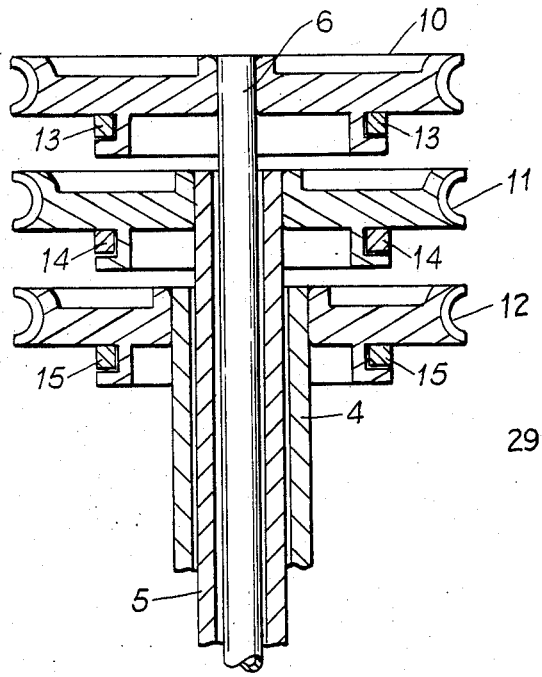
FIG. 3 is an exploded sectional view of the worm gears and tubes.

The assembly of elements 1, 2 and 3 is illustrated in further detail in FIG. 2. Element 1 is mounted on tube 4, element 2 is mounted on tube 5 and element 3 is mounted on tube 6. The elements are mounted on the tube by any of a number of conventional means: glues, fasteners, etc. Tubes 4, 5 and 6 are assembled concentrically and are secured to worm gears 10, 11 and 12 with an interference fit, FIG. 3. 13, 14 and 15 are split bushings.

Figure 4:
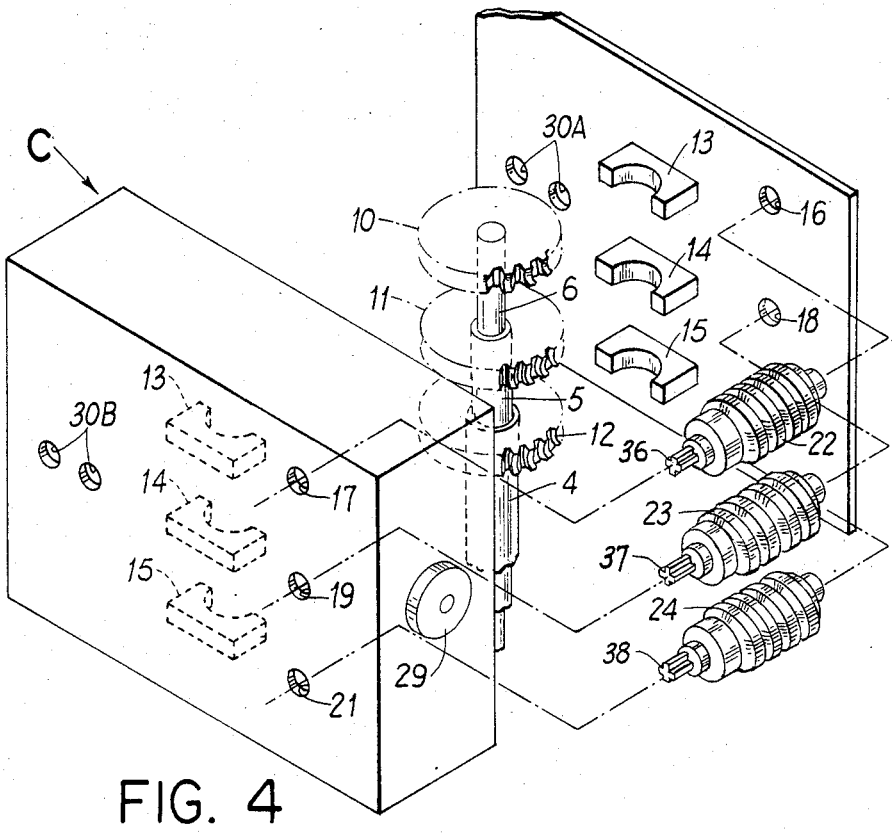
FIG. 4 is an isometric exploded view of a carrier with the worms and supports for the worm gears.

A carrier C which houses the worms and worm gears, and from which a vane is supported, is illustrated in FIG. 4. The concentric arrangement of tubes 6, 5 and 4 are supported within a carrier C by means of a plurality of split bushings 13-15. Apertures 16 and 17 rotatably support worm 22. Likewise, apertures 18, 19 and 20, 21 rotatably support worms 23 and 24 respectively. The worms 22, 23 and 24 have cruciform shaped axial passage ways that enable the worms to travel along their respective control rods 36, 37 and 38, FIG. 5. This permits horizontal traversement of a multiplicity of carriers C while maintaining the ability for control rods 36, 37 and 38 to drive worms 22, 23 and 24 respectively. Consequently, at any horizontal position of the vanes, the vane elements angular orientation can be controlled.

Figure 5:
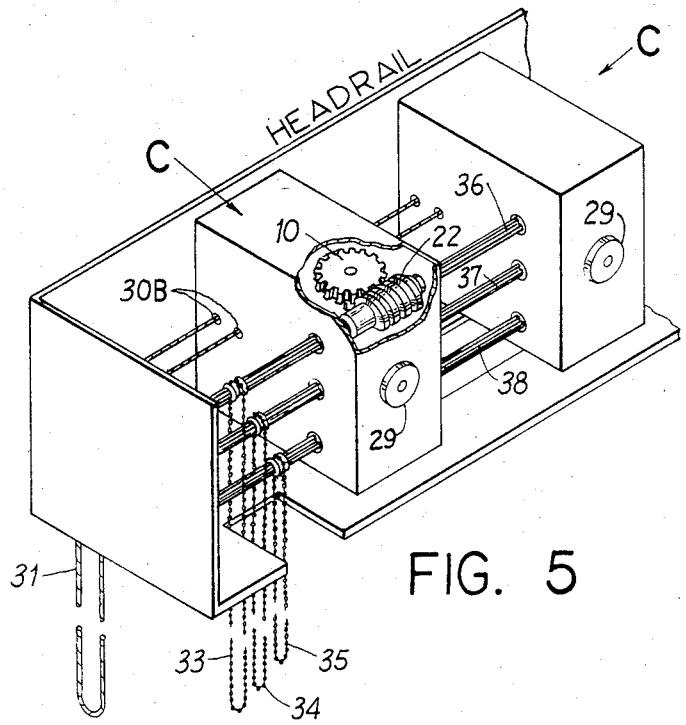
FIG. 5 is an exploded view inside the headrail.

FIG. 5. illustrates the means for independently controlling the angular orientation of the individual elements of a vertical vane V. 33, 34 and 35 are loops of beaded chain. The movement of beaded chain loop 33 will rotate the upper control rod 36 by means of a pulley secured to the upper control rod 36. Beaded chain loops 34 and 35 rotate their respective control rods 37 and 38 in the same manner. The control rods 36, 37 and 38 extend through all the carriers C. The rotation of control rod 36 causes the rotation of worm 22 within all the carriers C. Likewise, control rods 37 and 38 rotate worms 23 and 24 respectively. The rotation of worms 22, 23 and 24 will drive their respective worm gears 10, 11 and 12 which in turn rotate the elements 3, 2 and 1 respectively. Rotation of the control rod can be accomplished by other means known in the art, such as the use of a wand.

Figure 6:
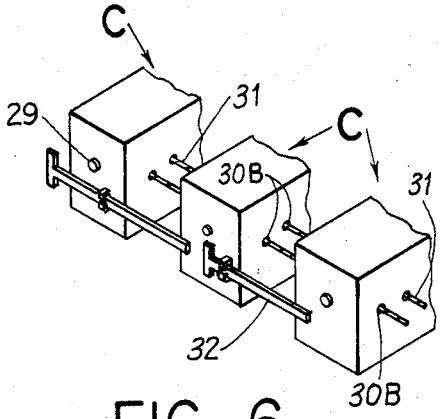
FIG. 6 is a detail of the traversing control for the horizontal movement of vanes.

Horizontal movement, "drawing" of the vanes, is by conventional means known in the art. One method is illustrated in FIG. 6. The carriers hang from the headrail on wheels 29. Apertures 30A, B in opposite side walls of the carriers C, FIG. 4, permits the traversing cord 31 to pass through, FIGS 5, 6. Spacing of the carriers C is accomplished by spacing clasps 32, FIG. 6.

The main advantage of the invention is that the user is no longer confined to the conventional adjustment of a vertical blind. The mechanical feature of mounting a plurality of vane elements on concentric tubes makes the independent sectioning possible. This enables the user to adjust any portion of the light entering a room or obtain any degree of privacy.

I claim:

1. A vertically discontinuous blind comprised of vertically arranged sections that are independently controllable in their opening and closing, comprising a plurality of parallel, closely spaced vertically extending vanes, each vane being comprised of a plurality of vane elements, an assembly of concentric elongated rods or tubes vertically extending through each vane, the innermost one of the tubes being secured to the lowermost element, the outermost tube being secured to the uppermost element, and the intermediate tubes, if any, of the assembly being secured to respective ones, if any, of the vertically arranged vane elements, a plurality of tube rotation means each coupled to a respective one of said tubes for independently rotating each tube, and means for independently actuating said tube rotation means.

2. The vertically discontinuous blind claimed in claim 1 wherein the combination includes, a plurality of carrier means for carrying a respective one of said vanes, said concentric tube assembly associated with a vane extending upwardly into a carrier member that supports the vane, said tube rotation means being secured to respective tubes in said carrier means, and said means for independently actuating said tube rotation means is in communication with each carrier means and is adapted to actuate all said rotation means.

3. The vertically discontinuous blind claimed in claim 2 wherein said means for actuating said tube rotation means includes a first actuating means for rotating together the tube rotation means associated with the uppermost element of each vane, and a second actuating means for rotating together the tube rotation means associated with the lowermost element of each vane.

4. The vertically discontinuous blind claimed in claim 3 wherein said means for actuating said tube rotation means includes one or more additional actuating means for rotating together the rotation means associated with one or more respective intermediate elements of each vane.

5. The combination claimed in claim 2 wherein said tube rotation means includes gear means secured to each one of said concentric tubes, and means for rotating each gear means.

6. The combination claimed in claim 5 wherein said gear means includes a worm gear and said means for rotating the gear means includes a worm.

7. The combination claimed in claim 6 and including means for supporting said worm gears and worms in said carrier means.

8. The combination claimed in claim 2 and including means for supporting said carrier means in substantially horizontal alignment, and means for translating at least some of said carrier means horizontally.

* * * * *